US008422690B2

(12) United States Patent
Matsuura

(10) Patent No.: US 8,422,690 B2
(45) Date of Patent: Apr. 16, 2013

(54) AUDIO REPRODUCTION APPARATUS AND CONTROL METHOD FOR THE SAME

(75) Inventor: Yasuhiro Matsuura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 12/942,609

(22) Filed: Nov. 9, 2010

(65) Prior Publication Data

US 2011/0135101 A1 Jun. 9, 2011

(30) Foreign Application Priority Data

Dec. 3, 2009 (JP) ..... 2009-275939

(51) Int. Cl.
*H04R 5/00* (2006.01)
*H04R 5/02* (2006.01)

(52) U.S. Cl.
USPC ..... 381/26; 381/1; 381/17; 381/309

(58) Field of Classification Search ..... 381/1, 2, 381/17–23, 26, 74, 306, 307, 309, 310, 313
See application file for complete search history.

(56) References Cited

U.S. PATENT DOCUMENTS

| | | | | |
|---|---|---|---|---|
| 5,666,425 | A * | 9/1997 | Sibbald et al. | 381/26 |
| 7,333,622 | B2 * | 2/2008 | Algazi et al. | 381/310 |
| 7,936,887 | B2 * | 5/2011 | Smyth | 381/74 |
| 8,045,840 | B2 * | 10/2011 | Murata et al. | 386/239 |
| 8,306,236 | B2 * | 11/2012 | Asada et al. | 381/58 |
| 2005/0147261 | A1 * | 7/2005 | Yeh | 381/92 |
| 2005/0190936 | A1 * | 9/2005 | Miura et al. | 381/309 |
| 2008/0044033 | A1 * | 2/2008 | Ozawa | 381/26 |

FOREIGN PATENT DOCUMENTS

JP 2001-326990 11/2001

* cited by examiner

*Primary Examiner* — Xu Mei
*Assistant Examiner* — William A Jerez Lora
(74) *Attorney, Agent, or Firm* — Cowan, Liebowitz & Latman, P.C.

(57) ABSTRACT

There is provided an audio reproduction apparatus. The audio reproduction apparatus comprises a first acquisition unit, a determination unit, a calculation unit, a second acquisition unit, and a generation unit. The configuration of the audio reproduction apparatus enables changing a head-related transfer function for signal processing in audio signal reproduction in accordance with the state of the audio recording apparatus at the time of audio signal acquisition.

4 Claims, 7 Drawing Sheets

: MICROPHONE : AUDIO SOURCE

AUDIO REPRODUCTION APPARATUS AND CONTROL METHOD FOR THE SAME

BACKGROUND OF THE INVENTION

1. Field of the Invention

The present invention relates to an audio reproduction apparatus and a control method for the same.

2. Description of the Related Art

Currently, technology is known in which a stereo audio signal is generated from audio signals acquired by a plurality of omnidirectional microphones. Also, technology is known in which, in the case where a stereo audio signal is generated from audio signals acquired during video capturing by an audio/video recording apparatus (for example, a video camera), the directional characteristics of the stereo audio signal are changed by changing the degree of amplification of the acquired audio signals in accordance with the zoom state. For example, Japanese Patent Laid-Open No. 2001-326990 discloses that in the case where the zoom magnification is high, the degree of amplification of an audio signal acquired by a microphone disposed in the center at the front is set higher than that of microphones disposed on the left and right, thus intensifying the forward directivity.

Also, there is pseudo surround audio signal processing technology, which is technology to increase realism during the reproduction of an audio signal. Pseudo surround audio signal processing is generally realized by crosstalk cancellation and computation processing that employs a head-related transfer function. A head-related transfer function is determined in accordance with the positional relationship between the pick-up location of a sound and the auditory location of the sound.

Although changing the zoom state of a video camera and changing the degree of amplification of a microphone can be considered to be the same as virtually changing the auditory location of a sound, such a notion has not been conceived conventionally. Accordingly, the notion of changing a head-related transfer function for pseudo surround audio signal processing in accordance with the zoom magnification of a video camera and the degree of amplification of a microphone has also not been conceived conventionally.

SUMMARY OF THE INVENTION

The present invention has been achieved in light of these circumstances, and in the present invention, a head-related transfer function for signal processing in audio signal reproduction is changed in accordance with the state of an audio recording apparatus at the time of audio signal acquisition.

According to an aspect of the present invention, there is provided an audio reproduction apparatus comprising:

a first acquisition unit configured to acquire one or more audio signals that has been recorded by an audio recording apparatus with use of one or more microphones included in an audio input unit that the audio recording apparatus comprises, an angle of a disposition location of each of the one or more microphones relative to a reference axis extending in one direction from an origin at a predetermined location of the audio input unit, and a degree of amplification of the audio signal from each of the one or more microphones at a time of recording of the one more audio signals by the audio recording apparatus;

a determination unit configured to determine a reference location on the reference axis;

a calculation unit configured to, for each virtual pick-up location of the one or more microphones determined based on the angle and the degree of amplification of the microphone acquired by the first acquisition unit, calculate a relative location of the virtual pick-up location relative to the reference location, each of the virtual pick-up locations being determined as a location that is on an axis having the angle relative to the reference axis and extending from the origin and that is farther from the origin as the degree of amplification is higher and closer to the origin as the degree of amplification is lower;

a second acquisition unit configured to, for each of the one or more microphones, acquire a head-related transfer function corresponding to the relative location of the microphone that has been calculated by the calculation unit; and a generation unit configured to, for each of the one or more audio signals acquired by the first acquisition unit, generate a pseudo surround audio signal based on the audio signal with use of the head-related transfer function acquired by the second acquisition unit.

According to another aspect of the present invention, there is provided a control method for an audio reproduction apparatus comprising:

a first acquisition step of acquiring one or more audio signals that has been recorded by an audio recording apparatus with use of one or more microphones included in an audio input unit that the audio recording apparatus comprises, an angle of a disposition location of each of the one or more microphones relative to a reference axis extending in one direction from an origin at a predetermined location of the audio input unit, and a degree of amplification of the audio signal from each of the one or more microphones at a time of recording of the one more audio signals by the audio recording apparatus;

a determination step of determining a reference location on the reference axis;

a calculation step of, for each virtual pick-up location of the one or more microphones determined based on the angle and the degree of amplification of the microphone acquired in the first acquisition step, calculating a relative location of the virtual pick-up location relative to the reference location, each of the virtual pick-up locations being determined as a location that is on an axis having the angle relative to the reference axis and extending from the origin and that is farther from the origin as the degree of amplification is higher and closer to the origin as the degree of amplification is lower;

a second acquisition step of, for each of the one or more microphones, acquiring a head-related transfer function corresponding to the relative location of the microphone that has been calculated in the calculation step; and a generation step of, for each of the one or more audio signals acquired in the first acquisition step, generating a pseudo surround audio signal based on the audio signal with use of the head-related transfer function acquired in the second acquisition step.

According to the above configuration, the present invention enables changing a head-related transfer function for signal processing in audio signal reproduction in accordance with the state of the audio recording apparatus at the time of audio signal acquisition.

Further features of the present invention will become apparent from the following description of exemplary embodiments with reference to the attached drawings.

DESCRIPTION OF THE EMBODIMENTS

Below is a description of embodiments for carrying out the present invention with reference to the drawings.

First Embodiment

Figure 1:
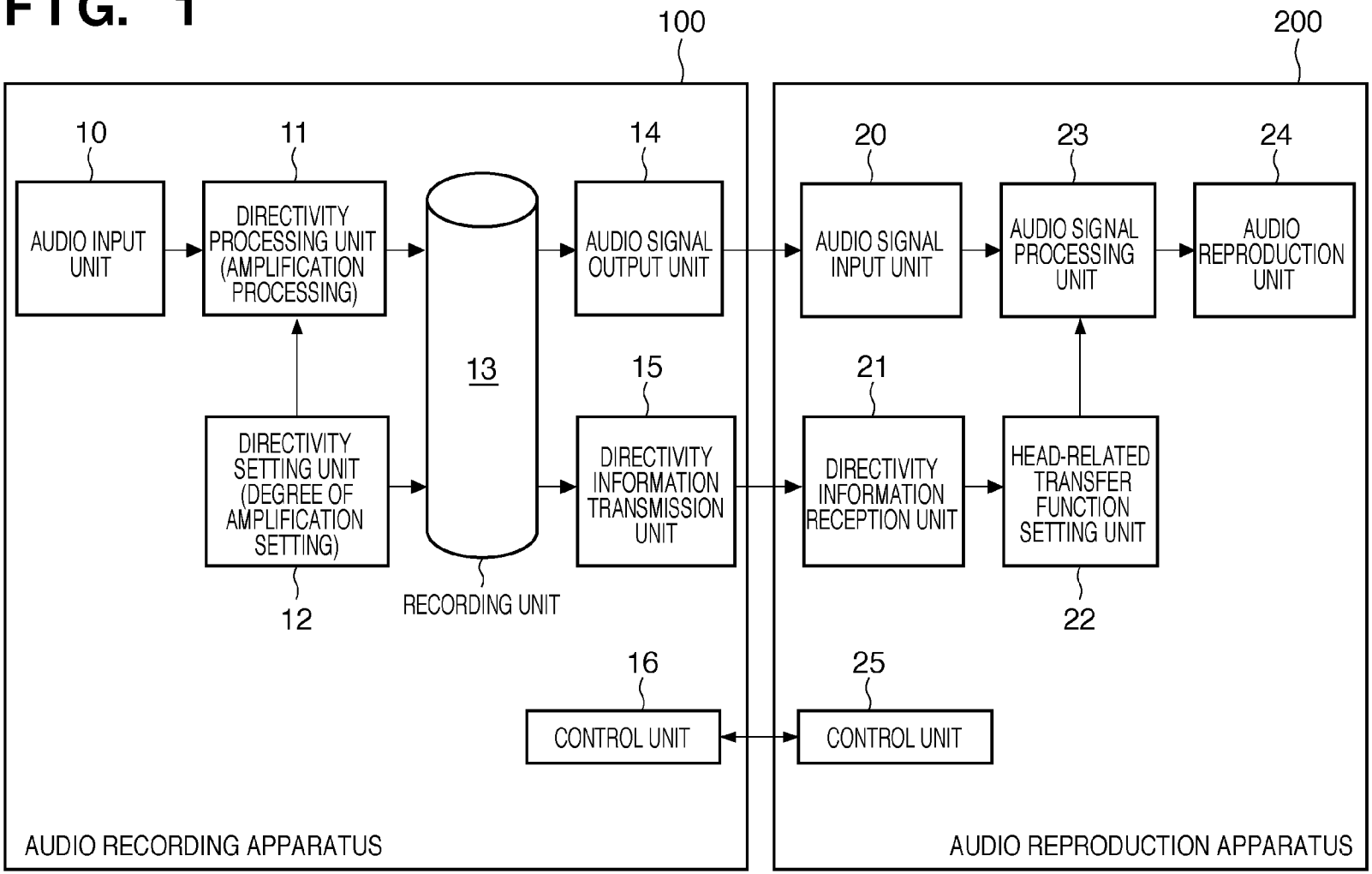
FIG. 1 is a block diagram showing a configuration of an audio reproduction apparatus 200 according to a first embodiment.

FIG. 1 is a block diagram showing a configuration of an audio reproduction apparatus 200 according to a first embodiment. The audio reproduction apparatus 200 is applicable to, for example, a cradle or a personal computer having an audio reproduction function. The audio reproduction apparatus 200 acquires an audio signal and the like from an audio recording apparatus 100. The audio recording apparatus 100 picks up audio with use of microphones and the like, and records audio emitted by an audio source as an audio signal onto a recording medium, examples of which include a magnetic device such as an HDD, and a semiconductor device such as an SSD. The audio recording apparatus 100 is applicable to, for example, an IC recorder, a PDA, or a mobile phone having an audio recording function.

Below is a detailed description of the audio recording apparatus 100 and the audio reproduction apparatus 200. The audio recording apparatus 100 includes an audio input unit 10, a directivity processing unit 11, a directivity setting unit 12, a recording unit 13, an audio signal output unit 14, a directivity information transmission unit 15, and a control unit 16. The audio reproduction apparatus 200 includes an audio signal input unit 20, a directivity information reception unit 21, a head-related transfer function setting unit 22, an audio signal processing unit 23, an audio reproduction unit 24, and a control unit 25. The audio signal input unit 20 and the directivity information reception unit 21 function as a first acquisition unit.

Figure 2:
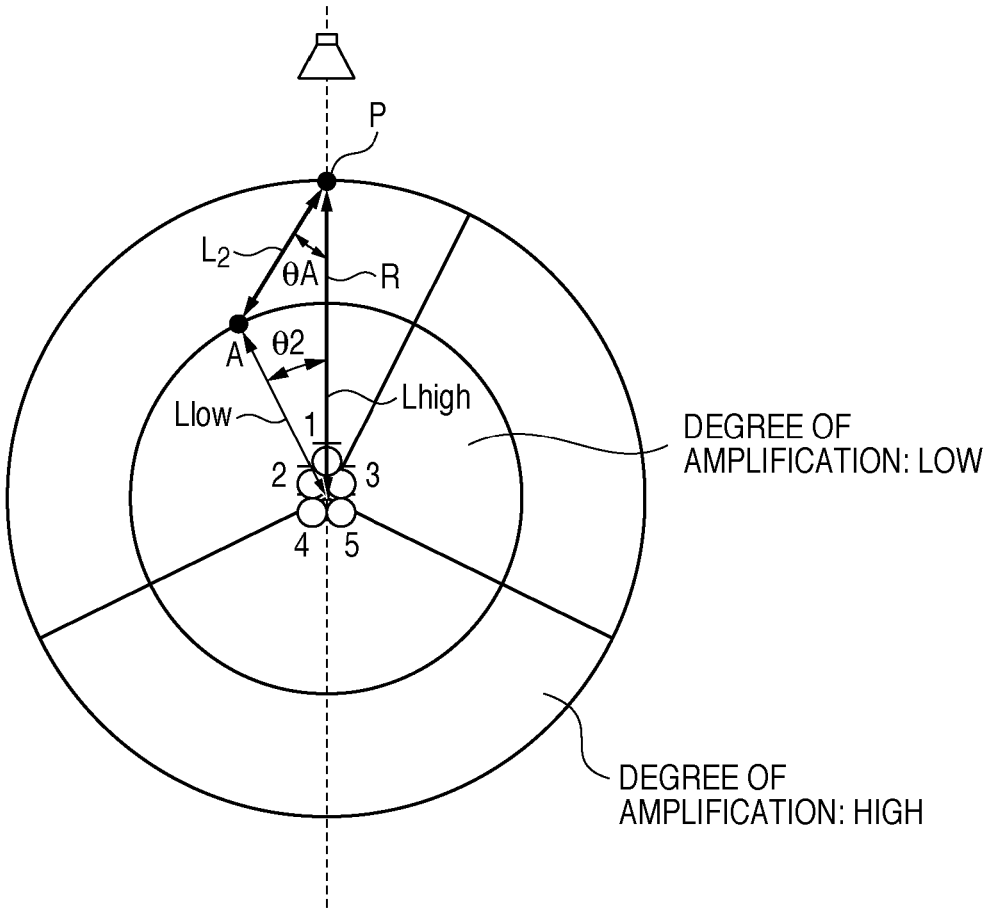
FIG. 2 is a diagram showing an example of an arrangement of microphones, and an example of a virtual auditory location and a pick-up location according to the first embodiment.

The audio input unit 10 includes one or more omnidirectional microphones, and the audio input unit 10 picks up audio in the periphery of the audio recording apparatus 100 and supplies the picked up audio as an audio signal to the directivity processing unit 11 that is downstream in the processing flow. The number of microphones is appropriately determined in accordance with the content of directivity signal processing performed by the directivity processing unit 11. As one example, the audio input unit 10 includes five microphones, as shown in FIG. 2. The microphones are disposed having a constant angle relative to a reference axis R extending from the origin in one direction (the forward direction of the audio recording apparatus 100).

The directivity processing unit 11 performs directivity signal processing on audio signals received from the audio input unit 10 (in particular, amplifies the audio signals received from the microphones). The directivity signal processing is performed based on directivity information set by the directivity setting unit 12. The directivity signal processing is considered to be processing in which the audio signals picked up by the omnidirectional microphones are multiplied by a predetermined coefficient, and a predetermined coefficient is added thereto, in accordance with the directivity information set by the directivity setting unit 12. The coefficient is considered to have been calculated in advance based on the number and arrangement of microphones, using a known technique.

The directivity setting unit 12 sets directivity information necessary for performing directivity signal processing on the audio signals. The directivity information includes degrees of amplification with respect to the audio signals from the microphones and the number of audio signal channels to be obtained after the directivity signal processing. The directivity setting unit 12 sets the directivity information at a predetermined time interval, and records the directivity information in the recording unit 13 as meta information associated with the audio signals. A user may manually issue an instruction for changing the directivity information settings, and the directivity setting unit 12 may automatically change the directivity information settings in accordance with the audio source.

The recording unit 13 includes, for example, a magnetic device such as an HDD or a semiconductor device such as an SSD, and the recording unit 13 records the audio signals subjected to directivity signal processing by the directivity processing unit 11. and the recording unit 13 also records the directivity information for each time interval.

The audio signal output unit 14 supplies the audio signals recorded in the recording unit 13 to the audio signal input unit 20 in the audio reproduction apparatus 200. The audio signals are, for example, transmitted as digital signals via HDMI, IEEE 1394, optical transmission, or the like, or transmitted as analog signals.

The directivity information transmission unit 15 supplies the directivity information reception unit 21 in the audio reproduction apparatus 200 with the directivity information that was set by the directivity setting unit 12 and is recorded in the recording unit 13. The directivity information is, for example, transmitted along with the audio signals via HDMI, IEEE 1394, or the like. Alternatively, in the case where the audio recording apparatus 100 and the audio reproduction apparatus 200 are connected by analog signal transmission, the directivity information may be transmitted with use of a dedicated line for transmitting meta information.

The control unit 16 performs central control of operations performed by the audio recording apparatus 100. Specifically, the control unit 16 has a central processing unit (CPU), a random access memory (RAM), a read only memory (ROM), and the like. In accordance with an operation signal corresponding to an operation that the user has performed on an operation unit (not shown), the control unit 16 supplies the various constituent elements with control signals for causing them to perform an audio signal recording operation, a directivity information change operation, an audio signal output operation, and the like.

Next is a description of the audio reproduction apparatus 200. The audio signal input unit 20 receives the audio signals that have been supplied by the audio signal output unit 14 in the audio recording apparatus 100. The directivity information reception unit 21 receives the directivity information that has been supplied by the directivity information transmission unit 15 in the audio recording apparatus 100.

Based on the directivity information received by the directivity information reception unit 21, the head-related transfer function setting unit 22 selects optimal head-related transfer functions from among head-related transfer functions that have been recorded in a memory (not shown) in advance, and supplies the selected head-related transfer functions to the audio signal processing unit 23.

The audio signal processing unit 23 performs pseudo surround audio signal processing by multiplying the audio signals by the head-related transfer functions supplied by the head-related transfer function setting unit 22. Here, crosstalk cancellation signal processing may also be included in the pseudo surround audio signal processing. Audio signals resulting from the pseudo surround audio signal processing are supplied to the audio reproduction unit 24.

The audio reproduction unit 24 includes an amplification unit and a speaker for outputting the audio signals supplied by the audio signal processing unit 23 as audio. The audio reproduction unit 24 amplifies the audio signals with use of the amplification unit, and outputs the amplified audio signals from the speaker as audio.

The control unit 25 performs central control of operations performed by the audio reproduction apparatus 200. In accordance with an operation signal based on an operation performed by the user, the control unit 25 supplies the various constituent elements with control signals for performing an audio signal reproduction operation, a pseudo surround audio signal processing setting operation, and the like.

Figure 3:
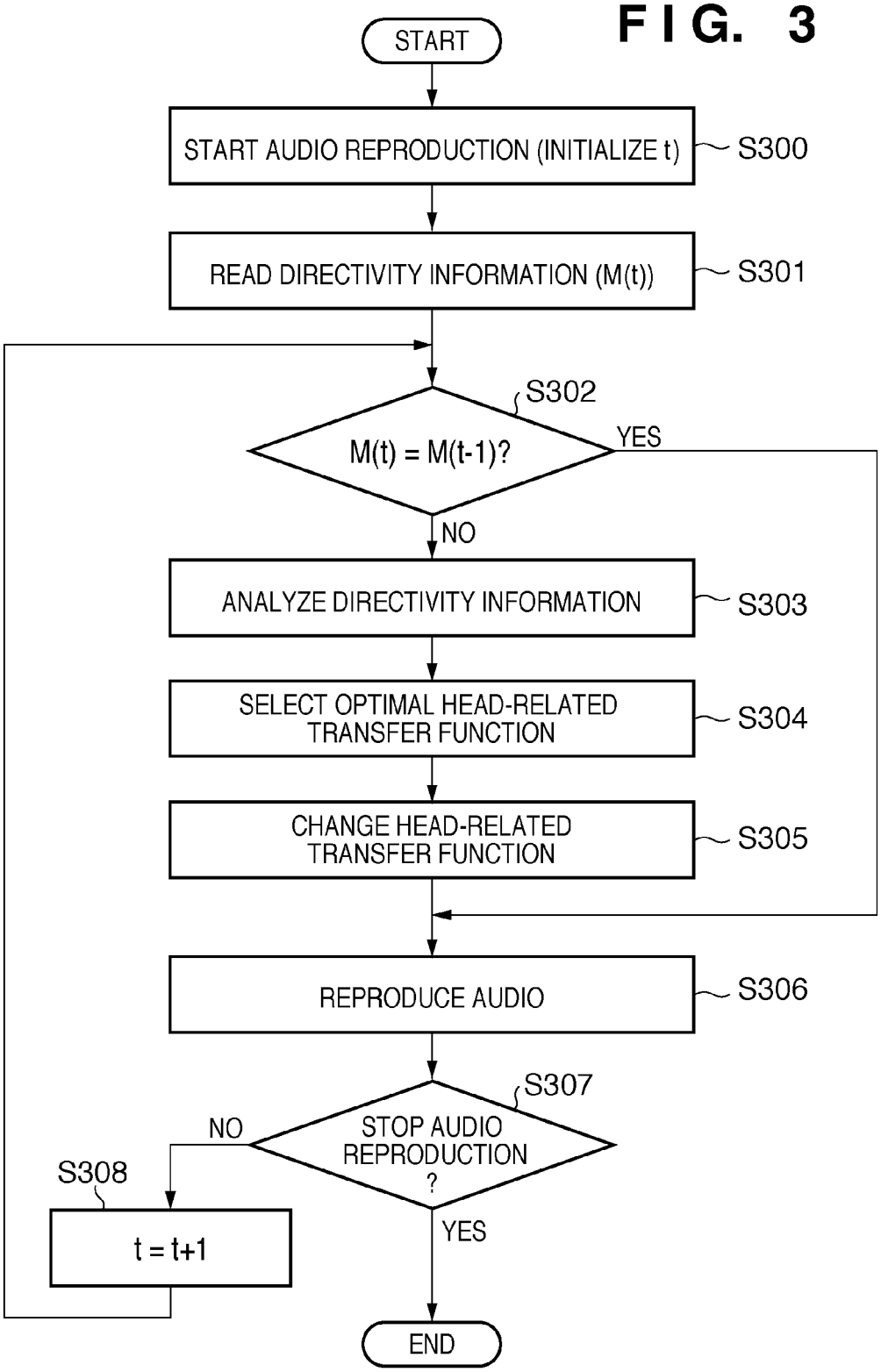
FIG. 3 is a flowchart showing audio signal reproduction processing executed by a control unit 16 in an audio recording apparatus 100 and a control unit 25 in the audio reproduction apparatus 200 according to the first embodiment.

Next, a description will be given of audio signal reproduction processing executed by the control unit 16 in the audio recording apparatus 100 and the control unit 25 in the audio reproduction apparatus 200 with reference to the flowchart in FIG. 3. The processing in this flowchart is realized by the control unit 16 and the control unit 25 respectively executing a control program.

In step S300, in accordance with an instruction for starting audio reproduction from the user, the control unit 25 instructs the control unit 16 of the audio recording apparatus 100 to output audio signals. In accordance with this instruction, the audio signal output unit 14 supplies the audio signal input unit 20 with audio signals. Here, the user may directly issue the audio reproduction start instruction to the audio recording apparatus 100. The audio signals supplied to the audio signal input unit 20 are sent to the audio signal processing unit 23 that is downstream in the processing flow.

In step S301, the control unit 25 instructs the audio recording apparatus 100 to output directivity information. In accordance with this instruction, the directivity information transmission unit 15 supplies the directivity information reception unit 21 with directivity information. The directivity information reception unit 21 reads the directivity information at a certain time interval. Here, directivity information at a reading time t is indicated as M(t).

In step S302, the control unit 25 determines whether the directivity information M(t) at the time t has changed from the immediately previous directivity information M(t−1). Note that if t=0 and immediately previous directivity information does not exist, the control unit 25 makes a determination that the directivity information has changed. The procedure advances to step S303 if the directivity information has changed, and advances to step S306 if otherwise.

In step S303, the control unit 25 performs a detailed analysis on the directivity information. The directivity information includes information such as the degrees of amplification of the microphones at the time of audio signal recording, the angles of the disposition locations of the microphones relative to the reference axis R, and the number of audio signal channels.

In step S304, the control unit 25 selects optimal head-related transfer functions from among those in the memory (not shown) based on the directivity information analyzed in detail, and thus functions as a determination unit, a calculation unit, and a second acquisition unit. The head-related transfer functions are calculated by, for example, performing measurement or simulation in advance based on the directivity state presumed to exist at the time of audio signal recording, and are stored in the memory in the audio reproduction apparatus 200 in the form of a table. Note that the head-related transfer functions are measured or calculated in accordance with the directivity control specifications in the audio recording apparatus 100 with which the audio reproduction apparatus 200 can be connected.

Below is a description of basic concepts related to the selection of a head-related transfer function. As shown in FIG. 2, a microphone 1 whose angle relative to the reference axis R is 0 degrees is used as a reference microphone. If the degree of amplification of the reference microphone is high, audio can be picked up from an audio source far away, and therefore the virtual auditory location (reference location) of the audio is considered to be a location (a reference location P in FIG. 2) far from the reference microphone on the reference axis R. Conversely, if the degree of amplification of the reference microphone is low, the virtual auditory location is considered to be a location close to the reference microphone on the reference axis R. The microphones other than the reference microphone are each considered to pick up audio at a location (location A in the case of a microphone 2 in FIG. 2) that is separated from the origin by a distance in accordance with the degree of amplification of the microphone, in a direction rotated from the reference axis R by the angle of the microphone. In the example in FIG. 2, the reference location P is a point on the reference axis R that is separated from the origin by a distance $L_{high}$. The location A is a point separated from the origin by a distance $L_{low}$, in a direction rotated from the reference axis R by an angle $\theta_2$.

Audio picked up by the microphone 2 is processed such that the audio can be perceived at the reference location P as being audio audible from the location A. As shown in FIG. 2, the relative location of the location A relative to the reference location P is expressed by an angle $\theta_A$ and a distance $L_2$. The angle $\theta_A$ and the distance $L_2$ are calculated in accordance with expressions (1) and (2) shown below.

$$L_2 = \sqrt{L_{high}^2 + L_{low}^2 - 2L_{high}L_{low}\cos\theta_2} \tag{1}$$

$$\theta_A = \frac{L_{high}^2 + L_2^2 - L_{low}^2}{2L_{high}L_2} \tag{2}$$

Figure 4:
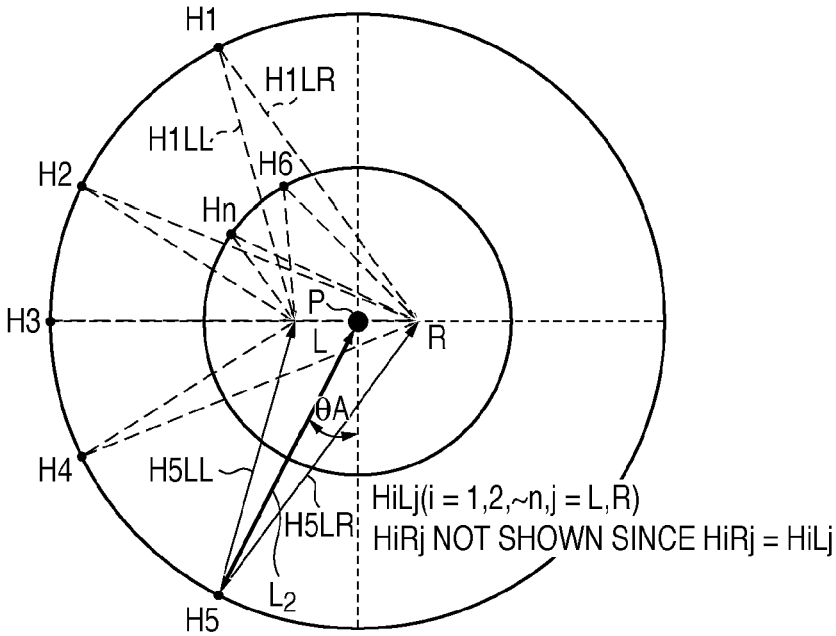
FIG. 4 is a diagram illustrating selection candidates among recorded head-related transfer functions, and a selection from among the selection candidates.

As shown in FIG. 4, a head-related transfer function selection candidate is recorded in the memory for each relative location relative to the reference location P. Head-related transfer functions for the locations on the right side of the reference axis do not need to be recorded (and have thus also been omitted from FIG. 2) since values for the left ear and values for the right ear are simply the inverse of each other. In FIG. 4, H5 denotes the location corresponding to the angle $\theta_A$ and distance $L_2$ calculated based on expressions (1) and (2), and the head-related transfer function recorded in correspondence with this location is selected as the head-related transfer function for the microphone 2 (H5LL for the left ear, and H5LR for the right ear). A description regarding the other microphones has been omitted due to being similar to the microphone 2.

Returning to FIG. 3, in step S305 the control unit 25 instructs the head-related transfer function setting unit 22 to set the head-related transfer functions selected in step S304 in the audio signal processing unit 23.

In step S306, the audio signal processing unit 23, which corresponds to a generation unit, executes pseudo surround audio signal processing with use of the head-related transfer functions set in step S305, and outputs the resulting pseudo surround audio signals to the audio reproduction unit 24.

Figure 5:
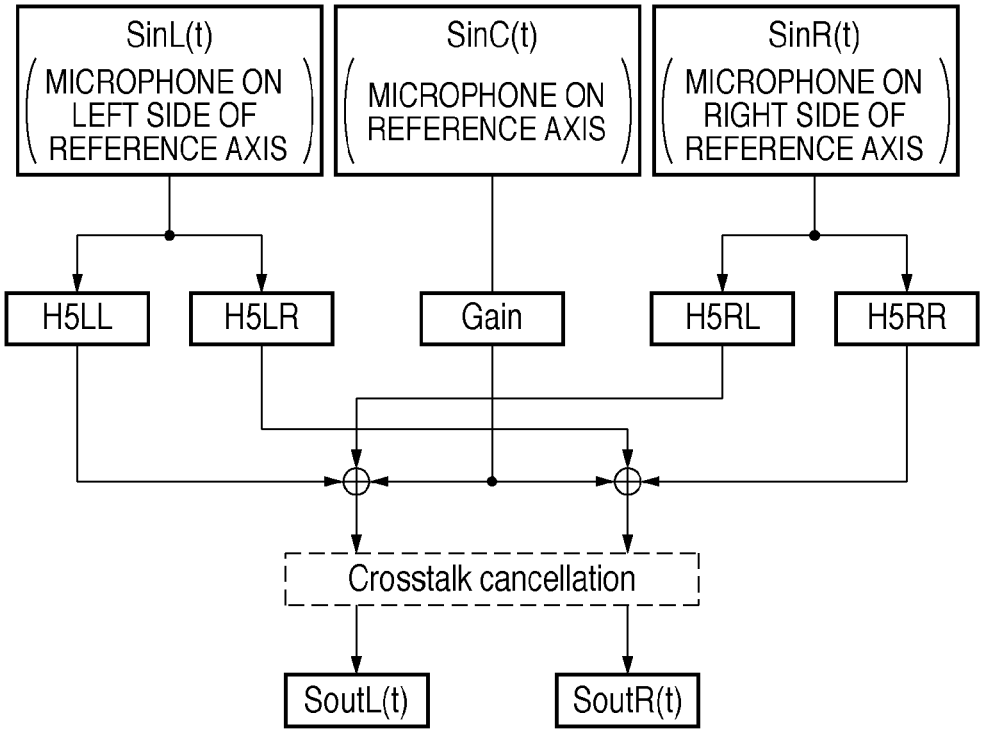
FIG. 5 is a diagram illustrating pseudo surround audio signal processing according to the first embodiment.

Below is a description of the pseudo surround audio signal processing with reference to FIG. 5. Sin L(t) indicates a left channel audio signal at a time t (an audio signal acquired by a microphone on the left side of the reference axis R), and Sin R(t) indicates a right channel audio signal at a time t (an audio signal acquired by a microphone on the right side of the reference axis R). Also, Sin C(t) indicates a center channel audio signal at a time (t) (an audio signal acquired by the microphone on the reference axis R). As one example, Sin L(t) corresponding to the microphone 2 is multiplied by H5LL for the left ear and by H5LR for the right ear. This obtains a left ear output audio signal SoutL(t) and a right ear output audio signal SoutR(t). After multiplication by the head-related transfer functions, crosstalk cancellation signal processing may be performed. Although FIG. 5 shows the example of H5LL, H5LR, H5RL, and H5RR as the head-related transfer functions, in actuality these head-related transfer functions change according to the angles and degrees of amplification of the microphones, as in the description given with reference to FIG. 4.

Returning to FIG. 3, in step S307 the control unit 25 determines whether an instruction for stopping audio reproduction has been received from the user. If the audio reproduction stop instruction has been received, the processing of this flowchart ends. If the audio reproduction stop instruction has not been received, the control unit 25 updates a reproduction time t in step S308, and then repeats processing from step S302.

As described above, according to the present embodiment, the audio reproduction apparatus 200 performs pseudo surround audio signal processing with use of head-related transfer functions that are in accordance with the angles and degrees of amplification of the microphones. This enables the user to experience a more realism during audio reproduction.

Second Embodiment

In a second embodiment, a description is given of the case of using an audio/video recording apparatus (an audio recording apparatus having a video capture function) such as a video camera as an audio recording apparatus. Whereas the reference location is determined with use of the degree of amplification of the microphone on the reference axis in the first embodiment, in the second embodiment, the location of a subject at the time of video capture by an audio/video recording apparatus is used as the reference location. The location of the subject can be calculated based on, for example, the zoom length and the focal length of the video camera.

Figure 6:
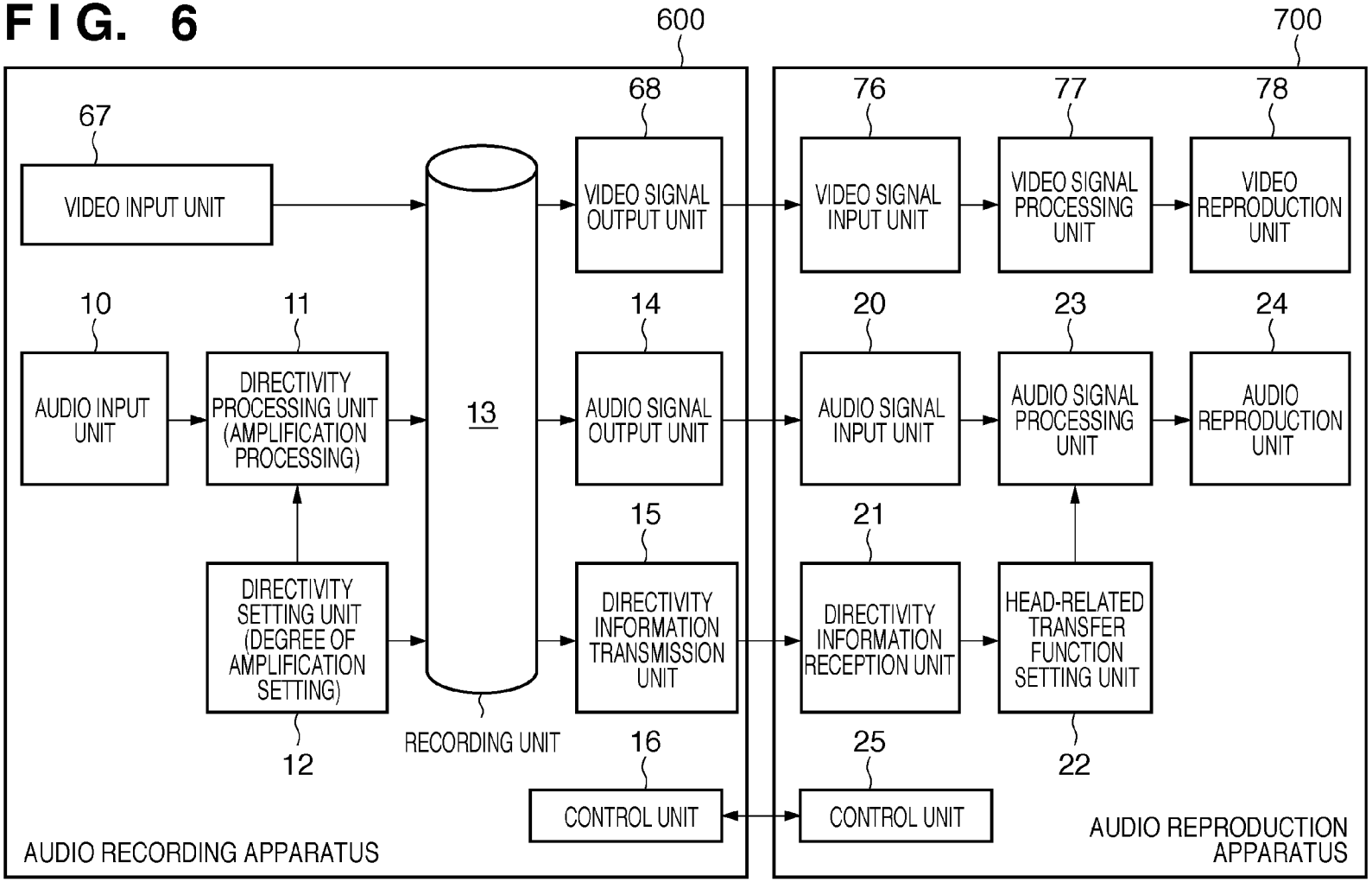
FIG. 6 is a block diagram showing a configuration of an audio reproduction apparatus 700 according to a second embodiment.

FIG. 6 is a block diagram showing a configuration of an audio reproduction apparatus 700 according to the second embodiment. The audio reproduction apparatus 700 acquires an audio signal and the like from an audio recording apparatus 600. The same reference numbers have been given to blocks in FIG. 6 that have functions that are the same as or similar to those in FIG. 1, and a description of such blocks has been omitted. The audio reproduction apparatus 700 is applicable to a television or the like. The audio recording apparatus 600 is applicable to a video camera or the like.

A video input unit 67 in the audio recording apparatus 600 includes a video capture unit and a signal processing unit. Video that has been input to the video capture unit is converted into a video signal by the signal processing unit, and the video signal is supplied to the recording unit 13 that is downstream in the processing flow. The video input unit 67 also controls the video capture unit in accordance with an instruction from the control unit 16. Specifically, the video input unit 67 performs, for example, zoom control for magnifying and reducing a video and focus control for focusing on a subject. Distances from the video capture unit to a subject are stored in advance in a memory (not shown) in the audio recording apparatus 600, in the form of a table having values in accordance with setting values of a zoom control signal and a focus control signal.

Note that in the second embodiment, the directivity information output by the directivity setting unit 12 may be determined based on zoom operation information of the video capture unit and focus operation information. Also, the user may manually issue an instruction for changing the directivity information settings, and the directivity setting unit 12 may automatically change the directivity information settings in accordance with the audio source based on, for example, the focal length obtained by a zoom operation performed in accordance with the subject or information regarding the focusing position.

The video signal output unit 68 outputs a video signal recorded in the recording unit 13 to the audio reproduction apparatus 700. The video signal can be, for example, transmitted as a digital signal via HDMI, IEEE 1394, or the like, or transmitted as an analog signal.

A video signal input unit 76 in the audio reproduction apparatus 700 receives the video signal output from the video signal output unit 68 in the audio recording apparatus 600. A video signal processing unit 77 performs signal processing related to video signals (for example, high definition processing and angle-of-view change processing) on the video signal received from the video signal input unit 76. If angle-of-view change processing has been performed by the video signal processing unit 77, audio directivity setting may be performed in accordance with the changed angle-of-view content. In this case, head-related transfer functions are considered to be set based on the directivity information determined in accordance with the angle-of-view change processing instead of the directivity information received by the directivity information reception unit 21.

A video reproduction unit 78 displays the video signal received from the video signal processing unit 77 on a video signal output device. The video signal output device may be a device that employs a PDP, an LCD, an SED, an organic EL, or the like. SED as referred to here is an abbreviation for Surface-conduction Electron-emitter Display. EL as referred to here is an abbreviation for Electro Luminescence.

Figure 7:
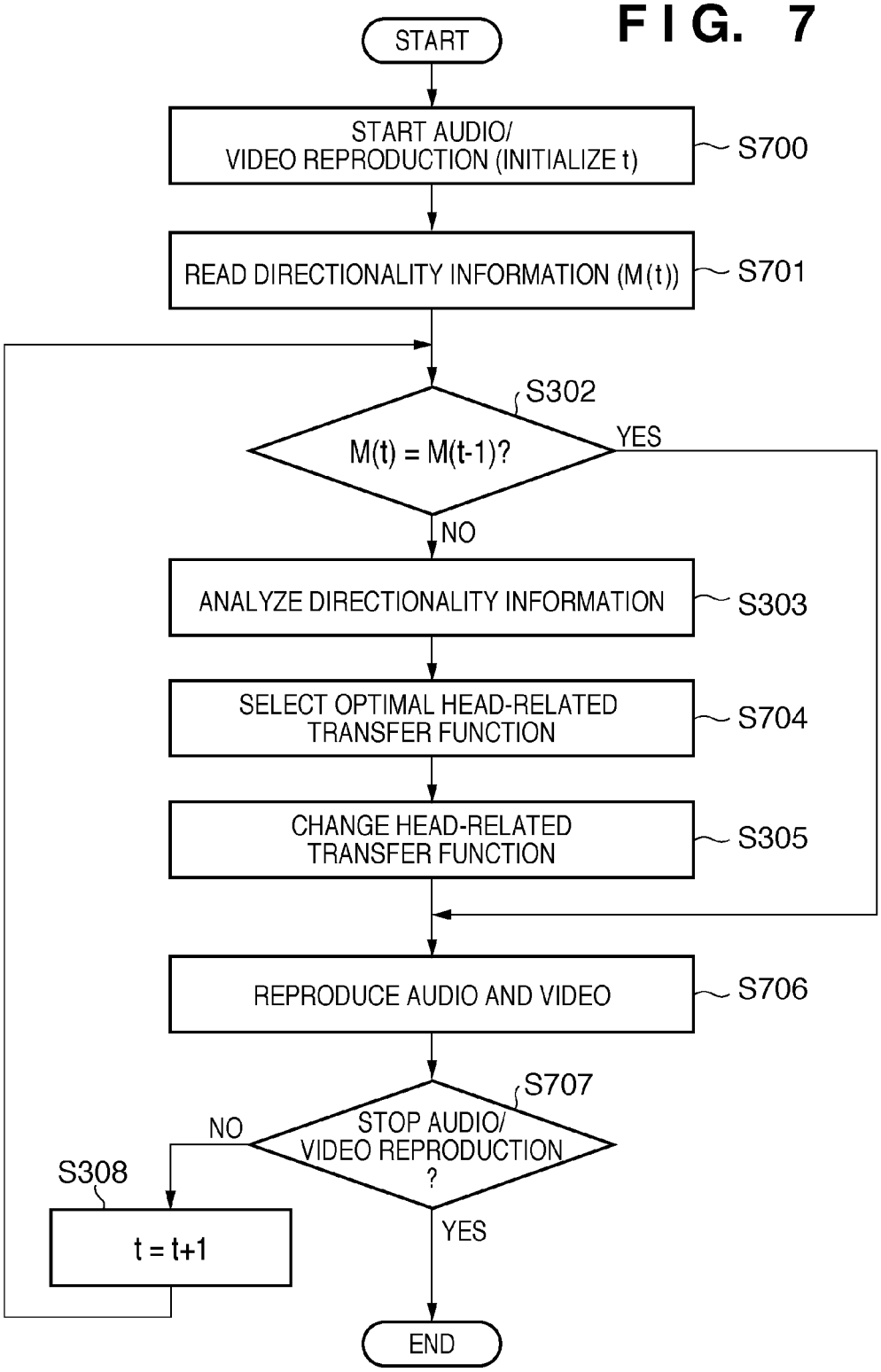
FIG. 7 is a flowchart showing audio/video signal reproduction processing executed by a control unit 16 in an audio recording apparatus 600 and a control unit 25 in the audio reproduction apparatus 700 according to the second embodiment.

Next, a description will be given of audio/video signal reproduction processing executed by the control unit 16 in the audio recording apparatus 600 and the control unit 25 in the audio reproduction apparatus 700 with reference to the flowchart in FIG. 7. The processing in this flowchart is realized by the control unit 16 and the control unit 25 respectively executing a control program. The same reference numbers have been given to steps in FIG. 7 for performing processing that is the same as or similar to steps in FIG. 3, and a description of such steps has been omitted.

In step S700, in accordance with an instruction to start audio/video reproduction from the user, the control unit 25 instructs the control unit 16 of the audio recording apparatus 600 to output a video signal and audio signals. In accordance with this instruction, the audio signal output unit 14 supplies the audio signal input unit 20 with audio signals. Also, the video signal output unit 68 supplies the video signal input unit 76 with a video signal. Here, the user may directly issue the audio/video reproduction start instruction to the audio recording apparatus 600. The audio signals supplied to the audio signal input unit 20 are sent to the audio signal processing unit 23 that is downstream in the processing flow. The video signal supplied to the video signal input unit 76 is sent to the video signal processing unit 77 that is downstream in the processing flow.

In step S701, the control unit 25 instructs the audio recording apparatus 600 to output directivity information. Unlike the first embodiment, in addition to the angles and degrees of amplification of the microphones, this directivity information includes information indicating the distance from the video input unit 67 to the subject (for example, information indicating the zoom state and the focus state). In accordance with this instruction, the directivity information transmission unit 15 supplies the directivity information reception unit 21 with directivity information. The directivity information reception unit 21 reads the directivity information at a certain time interval. Here, directivity information at a reading time t is indicated as M(t).

In step S704, the control unit 25 selects optimal head-related transfer functions from among those in the memory (not shown) based on the directivity information analyzed in detail. Below is a description of the difference in the selection performed in step S704 from the selection performed in step S304 in FIG. 3, with reference to FIG. 8.

Figure 8:
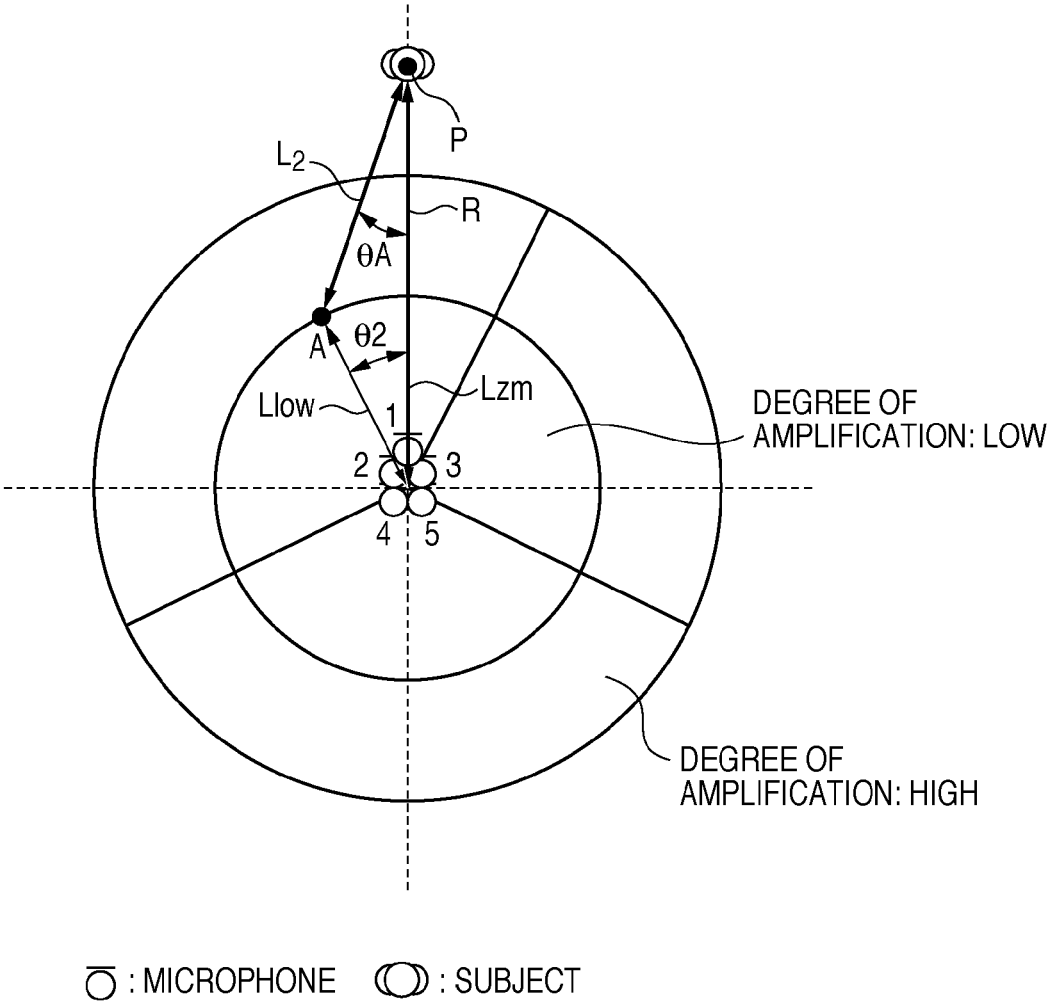
FIG. 8 is a diagram showing an example of an arrangement of microphones, and an example of a virtual auditory location and a pick-up location according to the second embodiment.

As shown in FIG. 8, the reference location P (virtual auditory location) in the second embodiment is a point on the reference axis R that is separated from the origin by a distance $L_{zm}$. $L_{zm}$ corresponds to the distance from the video input unit 67 to the subject. As one example, the angle $\theta_A$ and the distance $L_2$ that express the relative location of the pick-up location A of the microphone 2 relative to the reference location P are calculated in accordance with expressions (3) and (4) shown below instead of the previously-mentioned expressions (1) and (2).

$$L_2 = \sqrt{L_{zm}^2 + L_{low}^2 - 2L_{zm}L_{low}\cos\theta_2} \tag{3}$$

$$\theta_A = \frac{L_{zm}^2 + L_2^2 - L_{low}^2}{2L_{zm}L_2} \tag{4}$$

In step S706, the audio signal processing unit 23 executes pseudo surround audio signal processing with use of the head-related transfer functions set in step S305, and outputs the resulting pseudo surround audio signals to the audio reproduction unit 24. Also, the video signal processing unit 77 outputs the video signal to the video reproduction unit 78. The pseudo surround audio signal processing is similar to that in the first embodiment (see FIG. 5). However, although the pick-up location of the microphone 1 always matches the reference location P in the first embodiment, in the second embodiment, the pick-up location of the microphone 1 moves on the reference axis R in accordance with the degree of amplification. Accordingly, the head-related transfer function for the microphone 1 also changes in accordance with the degree of amplification.

In step S707 the control unit 25 determines whether an instruction for stopping audio/video reproduction has been received from the user. If the audio/video reproduction stop instruction has been received, the processing of this flowchart ends. If the audio/video reproduction stop instruction has not been received, the control unit 25 updates the reproduction time t in step S308, and then repeats processing from step S302.

As described above, according to the present embodiment, the audio reproduction apparatus 700 performs pseudo surround audio signal processing with use of head-related transfer functions that are in accordance with the angles and degrees of amplification of the microphones, as well as with the subject distance. This enables the user to experience a more realism during audio reproduction.

Although various embodiments of the present invention have been described above, the present invention is not intended to be limited to these embodiments, and various variations and modifications within the scope of the invention are possible. For example, the audio recording apparatus 100 and the audio reproduction apparatus 200 described in the first embodiment may be housed in a single housing. Also, regarding the audio reproduction apparatus 700 described in the second embodiment, the audio reproduction unit 24 and the video reproduction unit 78 may be housed separate from each other in different housings.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-275939, filed on Dec. 3, 2009, which is hereby incorporated by reference herein in its entirety.

What is claimed is:

1. An audio reproduction apparatus comprising:

a first acquisition unit configured to acquire one or more audio signals that has been recorded by an audio recording apparatus with use of one or more microphones included in an audio input unit that the audio recording apparatus comprises, an angle of a disposition location of each of the one or more microphones relative to a reference axis extending in one direction from an origin at a predetermined location of the audio input unit, and a degree of amplification of the audio signal from each of the one or more microphones at a time of recording of the one more audio signals by the audio recording apparatus;

a determination unit configured to determine a reference location on the reference axis;

a calculation unit configured to, for each virtual pick-up location of the one or more microphones determined based on the angle and the degree of amplification of the microphone acquired by the first acquisition unit, calculate a relative location of the virtual pick-up location relative to the reference location, each of the virtual pick-up locations being determined as a location that is on an axis having said angle relative to the reference axis and extending from the origin and that is farther from the origin as the degree of amplification is higher and closer to the origin as the degree of amplification is lower;

a second acquisition unit configured to, for each of the one or more microphones, acquire a head-related transfer function corresponding to the relative location of the microphone that has been calculated by the calculation unit; and a generation unit configured to, for each of the one or more audio signals acquired by the first acquisition unit, generate a pseudo surround audio signal based on the audio signal with use of the head-related transfer function acquired by the second acquisition unit.

2. The audio reproduction apparatus according to claim 1, wherein based on the degree of amplification of one microphone disposed on the reference axis among the one or more microphones, the determination unit determines the reference location to be a location on the reference axis that is farther from the origin as the degree of amplification is higher and closer to the origin as the degree of amplification is lower.

3. The audio reproduction apparatus according to claim 1, wherein the audio recording apparatus comprises an image pickup unit, the first acquisition unit furthermore acquires a location of a subject on the reference axis that has been picked up by the image pickup unit at a time of recording of the one or more audio signals by the audio recording apparatus, and the determination unit determines the reference location to be the location of the subject acquired by the first acquisition unit.

4. A control method for an audio reproduction apparatus comprising:

a first acquisition step of acquiring one or more audio signals that has been recorded by an audio recording apparatus with use of one or more microphones included in an audio input unit that the audio recording apparatus comprises, an angle of a disposition location of each of the one or more microphones relative to a reference axis extending in one direction from an origin at a predetermined location of the audio input unit, and a degree of amplification of the audio signal from each of the one or more microphones at a time of recording of the one more audio signals by the audio recording apparatus;

a determination step of determining a reference location on the reference axis;

a calculation step of, for each virtual pick-up location of the one or more microphones determined based on the angle and the degree of amplification of the microphone acquired in the first acquisition step, calculating a relative location of the virtual pick-up location relative to the reference location, each of the virtual pick-up locations being determined as a location that is on an axis having said angle relative to the reference axis and extending from the origin and that is farther from the origin as the degree of amplification is higher and closer to the origin as the degree of amplification is lower;

a second acquisition step of, for each of the one or more microphones, acquiring a head-related transfer function corresponding to the relative location of the microphone that has been calculated in the calculation step; and a generation step of, for each of the one or more audio signals acquired in the first acquisition step, generating a pseudo surround audio signal based on the audio signal with use of the head-related transfer function acquired in the second acquisition step.

* * * * *